US005302304A

United States Patent [19]

Valcho

[11] Patent Number: 5,302,304

[45] Date of Patent: Apr. 12, 1994

[54] SILVER PROTECTIVE LUBRICANT COMPOSITION

[75] Inventor: Joseph J. Valcho, Naperville, Ill.

[73] Assignee: Ethyl Corporation, Richmond, Va.

[21] Appl. No.: 847,747

[22] Filed: Mar. 5, 1992

Related U.S. Application Data

[63] Continuation-in-part of Ser. No. 633,088, Dec. 21, 1990, abandoned.

[51] Int. Cl.[5] ..... C10M 105/72; C10M 105/56

[52] U.S. Cl. ..... 252/47; 252/515 A; 252/33; 252/39; 252/41; 252/45; 252/48.2; 252/48.6

[58] Field of Search ..... 252/33, 39, 47, 51.5 A, 252/41, 45, 48.2, 48.6

[56] References Cited

U.S. PATENT DOCUMENTS

| | | | |
|---|---|---|---|
| 2,956,020 | 10/1960 | Suprin et al. | 252/33.4 |
| 3,110,673 | 11/1963 | Benoit, Jr. | 252/51.5 A |
| 3,272,746 | 9/1966 | LeSuer et al. | 252/515 A |
| 3,338,832 | 8/1967 | LeSuer | 252/47.5 |
| 3,341,542 | 9/1967 | LeSuer | 252/51.5 A |
| 3,869,394 | 3/1975 | Daniels | 252/50 |
| 4,257,779 | 3/1981 | Sung et al. | 252/50 |
| 4,263,015 | 4/1981 | Sung et al. | 252/51.5 A |
| 4,283,296 | 8/1981 | Nebzydoski et al. | 252/49.9 |
| 4,285,823 | 8/1981 | Sung et al. | 252/50 |
| 4,293,432 | 10/1981 | Papay et al. | 252/49.9 |
| 4,491,527 | 1/1985 | Lange et al. | 252/51.5 A |
| 4,849,118 | 7/1989 | Stauffer et al. | 252/48.2 |
| 4,871,465 | 10/1989 | Hutchinson | 252/47 |
| 4,908,145 | 3/1990 | Fenoglio | 252/51.5 A |
| 4,948,523 | 8/1990 | Hutchinson et al. | 252/47 |

FOREIGN PATENT DOCUMENTS

| | | |
|---|---|---|
| 0249162 | 6/1987 | European Pat. Off. . |

*Primary Examiner*—Margaret Medley
*Attorney, Agent, or Firm*—J. F. Sieberth

[57] ABSTRACT

A method of protecting silver parts and inhibiting copper corrosion in an internal combustion engine and a silver-wear and copper-corrosion protection additive in a lubricating composition comprising a major proportion of an oil of lubricating viscosity and a minor amount of a silver-wear and copper-corrosion protection additive comprising the reaction product of an amine, formic acid, and a $C_5$ to $C_{60}$ carboxylic acid.

17 Claims, No Drawings

SILVER PROTECTIVE LUBRICANT COMPOSITION

RELATED APPLICATION

This application is a continuation-in-part of copending U.S. patent application Ser. No. 07/633,088, filed Dec. 21, 1990, and now abandoned.

BACKGROUND OF THE INVENTION

The present invention generally relates to lubricant compositions and more specifically to a lubricant composition containing an additive that is useful in reducing both silver wear and copper corrosion.

Large numbers of medium speed diesel engines in the United States, as well as other countries, utilize silver-plated bearings. Apart from providing stability against oxidation and protection against the formation of sludge and carbonaceous deposits, crankcase lubricating oils intended for use in medium speed diesel engines must also be formulated with specialized silver protective agents in order that silver parts in the engine are not attacked either by the additives in the oil or by the dispersed neutralized decomposition products produced during extended engine operation. Such agents, often referred to as silver lubricity agents or silver-wear additives, protect against extreme pressure, wear and corrosion.

It is well known that zinc-containing wear agents such as zinc dihydrocarbyldithiophosphates (typically used in passenger cars) are incompatible with silver bearings and cannot be used for this purpose.

The antagonism between zinc-containing wear inhibitors and the silver parts in diesel engines has been circumvented in the prior art by using alternative silver lubricity agents, the most common of which are the chlorinated hydrocarbons. However, while the chlorine compounds of the prior art have been shown to be effective in protecting the silver parts of diesel engines, the Occupational Safety and Health Administration in the United States and other public health agencies throughout the world have expressed concern over potential biological effects of chlorinated compounds. Therefore, an incentive exists to develop novel compositions effective in protecting the silver parts of medium speed diesel engines which overcome the problems or potential problems encountered with the zinc-containing and chlorine-containing wear inhibitors.

A related problem in obtaining silver protection in lubricant compositions is that many of the heavy-duty diesel engines also contain copper-moving parts. It is believed that corrosive oils oxidize the copper and bring the copper residue into the oil. The copper residue catalyzes further oxidation which results in increased oil viscosity and premature oil additive failure. Accordingly, it is desirable that a lubricating oil inhibit copper corrosion and subsequent oil failure.

Therefore, a need exists for diesel lubricant compositions that will not only protect the silver parts of the diesel engine, but also operate so as to inhibit copper corrosion. It is particularly advantageous to provide a single additive that will afford both silver-wear protection and copper-corrosion protection.

Hutchison (U.S. Pat. No. 4,871,465) discloses lubricant compositions in which silver protection is afforded by a combination of an organo-sulfur compound and hydrocarbon-substituted 1,2,4-triazoles, the latter being obtained by reaction of a dicarboxylic acid compound, such as polybutyl-succinic anhydride, with a guanidine derivative (column 4, line 56 to column 5, line 3). In other words, Hutchison discloses a triazole formed from a dicarboxylic acid and guanidine. The likely structure of this reaction product is the bis-triazole having two five-membered heterocyclic rings, as illustrated at column 7, lines 33–39.

Hutchison (U.S. Pat. No. 4,948,523) discloses a silver protective lubricant composition including a silver protective agent comprising the reaction product of a $C_5$ to $C_{60}$ aliphatic carboxylic acid and at least one amine selected from the group consisting of (1) guanidine, urea, and thiourea compounds;

(2) $C_1$ to $C_{20}$ hydrocarbyl mono-amines, alkylene diamines, and polyalkylene polyamines; and (3) N-alkyl glycine.

Schmid (E.P. No. 249,162) discloses the use of 3-amino-1,2,4-triazoles as corrosion inhibitors for nonferrous metals (i.e., copper or zinc). The 3-amino-1,2,4-triazole of the reference is derived from formic acid and amino guanidine hydrogen carbonate. Schmid does not disclose silver protection, much less copper corrosion protection in diesel railroad locomotives.

Lange et al. (U.S. Pat. No. 4,491,527) discloses ester-heterocycle compositions useful as "lead paint" inhibitors in lubricants. Lange et al. teaches a combination of esters of substituted carboxylic acids and heterocyclic condensation products of the substituted carboxylic acids containing at least one heterocyclic moiety.

Lange, et al. is not directed to a lubricant composition for use in diesel engines having silver parts. In fact, at column 12, an illustrative lubricant composition is shown to include a zinc dialkylphosphorodithioate wear inhibitor. As noted above, zinc is unacceptable for use in silver-containing diesel engines.

LeSuer et al. (U.S. Pat. No. 3,272,746) discloses a detergent composition wherein the disclosure teaches that a critical aspect of the invention is the size of the hydrocarbon substituent, requiring at least 50 aliphatic carbon atoms. Further, LeSuer discloses several nitrogen-containing groups. However, LeSuer does not recognize that the particular nitrogen containing hydrazine of my invention is advantageous whereas the ethylenediamine that LeSuer teaches is equivalent in his invention is detrimental in my invention (see Comparative Examples D and E of the present specification).

In view of the problems cited earlier, a general object of the present invention is to provide a silver-wear and copper-corrosion protection lubricant additive.

A further object of the invention is to provide a silver-wear and copper-corrosion protection lubricant additive composition suitable for addition to lubricant compositions used to lubricate the moving parts of medium speed diesel engines such as found in railway locomotives, marine towboats, and stationary power applications.

SUMMARY OF THE INVENTION

I have now found that the foregoing objects are provided for in the present invention, namely, an internal combustion engine lubricating composition comprising a major proportion of an oil of lubricating viscosity and a minor amount of a silver-wear and copper-corrosion protection additive. The silver lubricating agent additive comprises the reaction product of a $C_5$ to $C_{60}$ aliphatic monocarboxylic acid, formic acid, and at least one hydrazine of the formula:

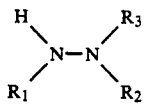

(I)

wherein $R_1$, $R_2$, and $R_3$ are independently selected from H, $C_1$ to $C_{20}$ hydrocarbyl, and hydroxy-substituted hydrocarbyl wherein the mole ratio of hydrazine to monocarboxylic acid is from about 0.8:1 to about 1.5:1, and the mole ratio of hydrazine to formic acid is from about 0.5:1 to about 1.5:1.

As a method, the invention is directed to the protection of silver engine parts in an internal combustion engine by lubrication thereof with the above-described lubricating compositions.

One advantage in the silver-wear and copper-corrosion protection additive prescribed for use in the lubricating compositions of the present invention, particularly in the context of medium speed railway diesel engines, is the fact that such agents are effective substitutes for the chlorine-containing silver-wear agents mentioned earlier. The more frequently used chlorine-containing agents are the chlorinated paraffins such as the commercial product "Chlorowax" (see Comparative Example C).

In another embodiment, the lubricating composition can contain a minor amount of an organo-sulfur compound selected from the group consisting of sulfurized olefins, sulfurized fatty acids and esters, sulfur-containing heterocyclic compounds, sulfurized hydroxy-aromatic compounds, disulfides, dithiocarbamates, and thiadiazoles. The compositions of the present invention are particularly effective as silver protectors and copper-corrosion inhibitors in diesel railroad locomotives.

DETAILED DESCRIPTION

In general, the silver-wear and copper-corrosion protection additives prescribed for use in the lubricating compositions of the present invention can be obtained by reacting in a conventional manner a $C_5$ to $C_{60}$ aliphatic monocarboxylic acid and an amine of Formula I with a formic acid.

Examples of suitable monocarboxylic acids include the saturated aliphatic monocarboxylic acids such as valeric caproic, caprylic, capric, lauric, myristic, palmitic, stearic, arachidic, behenic, and the like; cycloaliphatic acids such as cyclohexane monocarboxylic acid and cyclohexane dicarboxylic acid; unsaturated aliphatic monocarboxylic acids such as decenoic, decendioic, undecenoic, tridecenoic, pentadecenoic, pentadecenedienoic, heptadecenoic, oleic, linoleic, linolenic, ricinoleic and the like.

Monocarboxylic acids suitable for use in making silver-wear and copper-corrosion protection additive prescribed for use in the present invention include the commercially available fatty acids, or mixtures thereof, derived from corn oil, soybean oil, safflower oil, coconut oil, tall oil, tung oil, sunflower oil, rapeseed oil, cottonseed oil, peanut oil, palm kernel oil; linseed oil, olive oil, and castor oil, etc. Particularly preferred is a monocarboxylic unsaturated fatty acid of the formula:

$$R—CH_2—COOH \qquad II$$

wherein R is an alkenyl group, an alkedienyl group or an alketrienyl group containing about 5 to 60 carbon atoms. That is to say, the R groups will contain one, two, or three double bonds. Examples of such acids are myristoleic acid, palmitoleic acid, oleic acid, ricinoleic acid, linoleic acid, linolenic acid, eleostearic acid, elaidic acid, brassidic acid, arachidonic acid, abietic acid, and the like. Especially preferred is oleic acid. For purposes of the present invention, "oleic acid" means essentially neat oleic acid as well as commercially available oleic acid which, typically, comprises a major proportion of oleic acid in combination with lesser amounts of other fatty acids.

In the present invention, where the preparation of a reaction product calls for the reaction of a carboxylic acid, it should be understood that the term "carboxylic acid" encompasses reactive derivatives thereof such as anhydrides, alkylesters such as triglycerides, acid chlorides, arylesters, and the like.

In carrying out the reaction between the amine of Formula I, formic acid and carboxylic acid (preferably oleic acid), the mole ratio of hydrazine to carboxylic acid can be in the range of about 0.7:1 to about 1.2:1, and is preferably 0.9:1 to about 1:1. The reaction product preferred for use as a silver-wear and copper-corrosion protection additive in the present invention is obtained by reacting hydrazine with formic acid and adding oleic acid within a temperature range of from about 100° C. to about 182° C., and preferably from about 120° C. to about 145° C. Optimum yield can be obtained at these temperatures in from 1 hour to about 8 to 10 hours and preferably from about 1.5 to about 4 hours. The reaction can be carried out in a suitable solvent such as toluene and is preferably conducted in the presence of a small amount of anti-foamant due to vigorous foaming which can take place during the reaction.

In greater detail, the synthesis involves the neutralization of hydrazine with formic acid at room temperature, followed by reaction with oleic acid. The reaction is believed to proceed as follows:

$$\underset{\text{hydrazine monohydrate}}{H_2NNH_2} + \underset{\text{90\% formic acid}}{HCO_2H} \longrightarrow$$

$$H_2NN^+H_3 + HCO_2^- \xrightarrow[\text{oleic acid}]{C_{17}H_{33}CO_2H} \underset{\text{formylhydrazine oleamide}}{C_{17}H_{33}CONHNHCHO}$$

The salt can be made at room temperature to 130° C., with 27° C. to 93° C. being preferred. Anhydrous hydrazine or 30 weight percent of the total composition (wt. %) to 64 wt. % aqueous hydrazine may be used, with 54 wt. % to 64 wt. % hydrazine being preferred. Anhydrous or aqueous formic acid may be used with 90 wt. % formic acid containing 10 wt. % water being preferred.

The reaction with oleic acid can be carried out at 143° C. to 216° C., with 160° C. being preferred. The mole ratio of hydrazine to oleic acid can be 0.8:1 to 1.5:1, with 0.94:1 being preferred. The hydrazine to formic acid ratio can be 0.5:1 to 1.5:1, with 1:1 being preferred. The formylhydrazine oleamide was found to give good wear and oxidation performance (see Examples 1, 2, and 3).

Suitable hydrazines for use in the present invention may be mono- or 1,2-disubstituted with alkyl, aryl, or hetercyclic groups, such as, but not limited to, methylhydrazine, ethylhydrazine, 1,2-dimethylhydrazine, 1,2-diethylhydrazine, phenylhydrazine, 1,2-diphenylhydrazine, 2-hydrazinopyridine, and 2-hydrazino-2-imidazoline. Acid salts of these or other substituted hydrazines may also be used.

Suitable formic acids include the alkyl or aryl esters of formic acid, for example, methylformate, ethylformate, phenylformate, benzylformate, and the like.

The oil of lubricating viscosity suitable for use in preparing the lubricant compositions of the present inventions can be of synthetic, animal, vegetable, or mineral origin. Ordinarily, mineral lubricating oils are used by reason of their availability, general excellence, and low cost. Normally, the lubricating oils preferred will be fluid oils, ranging in viscosity of about 5 to 20 centistokes (cSt) at 100° C.

The preferred lubricant oil for use in the compositions of the present invention is a mineral base oil. The mineral base oil can be a blend of lubricant oils having viscosities such that the final viscosity at 100° C. of the lubricating oil composition is preferably in the range of about 12.0 cSt to 17.0 cSt. Thus, the suitable base lubricant mineral oil is selected to conform to viscosity requirements. The mineral base oil used to prepare the lubricating composition of the present invention preferably comprises a major portion, i.e., at least about 70 percent, and still more preferably, at least about 85 percent, by weight of the total composition. A viscosity index improver can be included.

In addition to a major proportion of mineral oil of lubricating viscosity, the lubricating compositions of the present inventions contain a minor amount of silver-wear and copper-corrosion protection additive. A minor amount of the silver-wear and copper-corrosion protection additive prescribed for use in the present invention which is sufficient to provide silver and copper protection in the lubricating compositions of the present invention is typically an amount that is within the range of about 0.01 wt. % to about 10 wt. %, based on the weight of the total lubricating oil composition. Preferably, the amount is within the range of about 0.1 wt. % to about 7 wt. % and, more preferably, the amount is within the range of about 0.2 wt. % to about 1.0 wt. %, based on the weight of the total lubricating oil composition.

The lubricating compositions comprising silver protecting amounts of the silver-wear and copper-corrosion protection additive of the present invention can further include an organo-sulfur compound. The amount of organo-sulfur compound present in the total lubricating composition can range from about 0.01 to about 1 wt. % of the total composition, preferably from about 0.05 to about 0.2 wt. %.

While any organo-sulfur compound can be used in the present invention, preferred are compounds selected from the group consisting of sulfurized olefins, sulfurized fatty acids and esters, sulfur-containing heterocyclic compounds, sulfurized hydroxy-aromatic compounds, disulfides, dithiocarbamates and thiadiazoles. Also included is a substituted 1,3,4-thiadiazole. For example, 2,5-dimercapto-1,3,4-thiadiazole, 2,5-bis(hydrocarbyldithio)-1,3,4-thiadiazole, 2-mercapto-5-hydrocarbyldithio-1,3,4-thiadiazole, 2,5-bis(hydrocarbylthio)-1,3,4-thiadiazole, and the like. A particularly preferred 1,3,4-thiadiazole composition for use in the present invention is 2,5-bis(hydrocarbyldithio-1,3,4-thiadiazole where the hydrocarbyl substituent is $C_1$ to $C_{30}$ alkyl. Most preferably, the hydrocarbyl is selected from the group consisting of heptyl, octyl, nonyl, decyl, undecyl, dodecyl, cetyl, and isomers thereof.

The 1,3,4-thiadiazole compounds and bis(2-hydroxyethyl) disulfide or mixtures thereof, can be readily obtained from commercial sources such as the Amoco Petroleum Additives Company, or can be synthesized from hydrazine and carbon disulfide in a well-known manner. Particularly preferred for use in the invention are thiadiazole compositions commercially available from the Amoco Petroleum Additives Company under the trade names "Amoco-153" and "Amoco-158." U.S. Pat. Nos. 2,765,289; 2,749,311; 2,760,933; 2,850,453; 2,910,439; 3,663,561; 3,862,798; and 3,840,549 may be referred to for detailed procedures on the preparation of the 1,3,4-thiadiazole compounds contemplated for use in lubricating compositions of the present invention. These patents are incorporated herein by reference.

In addition to the silver-wear and copper-corrosion protection additive of the present invention, and organo-sulfur compounds, the lubricating compositions of the present invention can contain additional additives to impart qualities considered necessary in a lubricating oil such as dispersancy, detergency, oxidation inhibition, and foam inhibition.

A class of oil-soluble dispersants suitable for incorporation in the lubricating compositions of the present invention are the Mannich dispersants obtained from the condensation under Mannich reaction conditions of a hydroxyaromatic compound, aldehyde-yielding reagent, and amine. Preferred Mannich reactants are: (a) a high molecular weight alkyl-substituted hydroxyaromatic whose alkyl substituent has a number average molecular weight of about 600–100,000, preferably a polyalkylphenol whose polyalkyl substituent is derived from 1-mono-olefin polymers (preferably polybutene) having an MN of about 850–2,500; (b) an amine containing at least one primary or secondary —NH group, preferably an alkylene polyamine selected from the group consisting of diethylenetriamine, triethylenetetraamine, tetraethylenepentaamine or mixtures thereof; and (c) an aldehyde, preferably formaldehyde, paraformaldehyde or formalin. The preparation of Mannich base dispersants (borated and non-borated) is disclosed in Piasek, et al., U.S. Pat. Nos. 3,697,574; 3,703,536; 3,704,308; 3,751,365; 3,756,953; 3,998,165; 3,798,247; and 3,803,039, all of which are incorporated herein by reference.

A further class of oil-soluble dispersants suitable for incorporation in the lubricating compositions of the present invention are the carboxylic polyamine dispersants, more frequently termed "succinimides," given that the most prevalently used dispersant to this class is the reaction product of an alkenyl-substituted succinic acid or anhydride with a nitrogen-containing compound. The succinic dispersants that can be used in the present invention are disclosed in numerous references and have become well known in the art. Examples are taught in U.S. Pat. Nos. 3,172,892, 3,219,666, and 3,272,746. If desired, borated succinic dispersants can also be used. See for example, U.S. Pat Nos. 3,087,936 and 3,254,025. A preferred succinic dispersant for use in the present invention is the reaction product of a polybutenyl succinic anhydride, wherein the polybutenyl group has a number average molecular weight between about 700 and 5,000, and the polyethylenepolyamine is selected from the group consisting of diethylenetriamine, triethylenetetramine, tetraethylenepentamine, and mixtures thereof.

A further class of dispersants suitable for use in the present invention is the succinate ester-amide dispersants, the latter term denoting the reaction product a long-chain aliphatic hydrocarbyl-substituted succinic acid or anhydride with an N-substituted hydroxyalkylamine. Representative patents disclosing this type of ashless dispersant are Malec, U.S. Pat. No. 4,426,305; and LeSuer, U.S. Pat. Nos. 3,219,666, 3,640,904 and 3,282,955, all of which are incorporated herein by reference. Preferred succinate ester-amide dispersants suitable for use in the lubricating compositions of the present invention are prepared by reacting a polybutenyl succinic acid composition and an alkylene diamine, preferably hexamethylenediamine, said alkylene diamine having an average of at least about 2.5 N-hydroxyalkyl groups. If desired, the succinate ester-amides can be borated with boron oxide, boron dihalides, boron acids, etc. (U.S. Pat. No. 4,873,009, incorporated herein by reference).

Another class of dispersants suitable for use in the present invention comprise the reaction products of aliphatic of alicyclic halides containing at least about 40 carbon atoms with amines, preferably, polyalkylene polyamines, examples of which dispersants are described in U.S. Pat. Nos. 3,275,554; 3,438,757; 3,454,555; and 3,565,804, all of which are incorporated herein by reference.

Still another type of dispersant which can be used in the lubricating compositions of the present inventions are polymers containing an oil-solubilizing group, for example a pendant alkyl group having at least about 8 carbon atoms, and a polar group, for example, polymers of decyl methacrylate, vinyl decyl ether, or a relatively high molecular weight olefin with aminoalkyl acrylates, aminoalkyl acrylamides, or poly-(oxyalkalene)-substituted alkyl acrylates, as well as copolymers of styrene, alkyl maleates, and maleic acid amides or imides respectively. Such polymers can generally be identified as polymeric polyamine dispersants and are exemplified in U.S. Pat. Nos. 3,329,658; 3,449,250; 3,519,565; 3,666,730; 3,687,849; and 3,702,300, all of which are incorporated herein by reference.

In addition to the dispersant compositions described above, the lubricating compositions of the present invention also preferably include basic detergent additives providing a TBN (total base number) of at least about 7, and preferably, within the range of about 10 to about 30. Examples of components that are suitable for providing the required TBN in the additive composition of the present invention are overbased alkali or alkaline earth metal sulfonates, phenates and salicylates. The sulfonates are normal or basic metal salts of petroleum sulfonic acids or long-chain alkyl-substituted benzene sulfonic acids. The phenates are normal or basic salts of alkylphenols, alkylphenol sulfides, and alkylphenolaldehyde condensation products. As is known in the art, a normal metal salt of an acid is a salt which contains the stoichiometric amount of metal required for the neutralization of the acidic group or groups present in the acid, while a basic salt or overbased salt is a salt which contains more metal than is required to stoichiometrically neutralize the acidic group or groups present. As well known in the art, overbased sulfonate is prepared by mixing a promoter, catalyst or solvent with a normal sulfonate and a larger excess of metallic base, followed by heating, carbonation and filtration. Carbonation of the reaction mass, accomplished conveniently with carbon dioxide, is employed to increase the amount of metal base colloidally dispersed as metal carbonate in the filtered product. Phenols, thioacids of phosphorous, alcoholates, alcohols, ketones, and alkanolamines can be used as promoters or catalysts. Typically, metallic bases are basic compounds of alkali or alkaline earth metals, such as sodium calcium, barium or magnesium. Overbased metal detergents are discussed thoroughly in the prior art. Examples of such art are U.S. Pat. Nos. 3,865,956; 2,956,018; 2,671,430; 3,779,920; 3,907,691; 4,137,184; 4,261,840; and 4,326,972. The overbased metal phenates are described in U.S. Pat. Nos. 2,680,096, 3,036,917; 3,178,368; 3,194,761; 3,437,595; 3,464,910; 3,779,920; and 4,518,807. All of the patents mentioned here are incorporated herein by reference. Numerous references also disclose methods of preparation for overbased salicylates.

A particularly preferred lubricating composition embodying the present invention has a TBN of at least 5 and comprises: (1) a major amount (at least 50 weight percent of the total lubricating composition) of an oil of lubricating viscosity; (2) from about 0.05 to about 10 weight percent of the silver-wear and copper-corrosion protection additive of the present invention; (3) from about 1 percent to about 10 weight percent of an ashless dispersant compound containing from about 40 weight percent to about 50 weight percent active component and selected from the group consisting of Mannich base dispersants, succinic dispersants, and succinate esteramide dispersants; (4) from about 0 to about 20 weight percent alkali or alkaline earth metal detergent compositions to provide alkalinity reserve, oxidation inhibition and detergency to the lubricating oil composition, said alkaline earth metal compositions being selected from the group consisting of calcium alkylsulfonates, magnesium alkylsulfonates, sodium alkylsulfonates, calcium alkylphenolates, magnesium alkylphenolates, calcium alkylsalicylates, magnesium alkylsalicylates, and mixtures thereof; and (5) from about 0.01 to about 1 weight percent organo-sulfur compound.

The above embodiments can be prepared by suspending or dissolving in the mineral oil various additives. The mineral oil used can be selected to conform to viscosity requirements. Either a single base oil or blends of different viscosity base oils may be used as the base oil for the additive lubricant oil. The components may be blended in any order and in any combination. Components (1) and (2) are discussed above. Component (3) of the preferred lubricant composition is a high molecular weight ashless dispersant, i.e., the Mannich condensation reaction obtained by reacting a polyalkylphenol, a polyamine and formaldehyde (Mannich dispersant). The alkylphenol is commonly a high molecular weight alkylsubstituted hydroxyaromatic compound such as polypropyl phenol, polybutyl phenol or other alkylphenols. These alkylphenols may be obtained by the alkylation of phenol in the presence of an alkylating catalyst such as $BF_3$-HF, $BF_3$ or $AlCl_3$ with high molecular weight polypropane, polybutene or other polyalkene compounds to give alkyl substitutions on the benzene ring of the phenol, having a number average molecular weight of from about 600 to about 100,000. These alkyl-substituted hydroxyaromatic compounds may be derived from polypropenes, polybutenes and other polymers of monoolefins, principally 1-butene, 2-butene, isobutene and propene. Also, monomers may be copolymerized with propene, butene, or other derivatives of monoalkene compounds. The ashless dispersants may also contain fatty acids. The fatty acids compounds are thought to promote ease of production of the additives. Fatty acids such as oleic, linoleic, stearic and other $C_{16}$ to $C_{24}$ acids are suitable. Oleic acid is generally preferred. Preferably, the configuration of the alkyl-substituted hydroxyaromatic compound is that of para-alkylphenol. However, other alkylphenols are relatively reactive and thus useful in preparation of the Mannich dispersant. Representative amine reactants for use in preparing the Mannich dispersant preferred for use in the present invention are alkane polyamine, principally, polyethylene polyamines. Examples of amines which are useful are ethylamine, diethylamine, dimethylamine or propylamine; ethylenediamine, diethylenetriamine, triethylenetetramine, tetraethylenepentaamine, pentaethylenehexamine, etc., and mixtures of the amines. Representative aldehydes for use in preparing the Mannich dispersant include paraformaldehyde, formalin, acetaldehyde, and betahydroxybutyraldehyde. Preferably, a formaldehyde or formaldehyde-yielding reactant is used.

Component (4), is an alkali or alkaline earth metal detergent, such as overbased alkylsulfonates. Such overbased alkylsulfonate can be produced from alkylated benzene sulfonic acid. The alkylated benzene sulfonic acid is generally produced by sulfonating benzene alkylates. The broad class of benzene alkylates include such compounds as polypropylbenzene, poly-t-butylbenzene, polyisobutylbenzene, poly-2-butylbenzene, polyethylenebenzene and copolymers of propyl and 1-butylbenzene and other various copolymers of ethylene, propene and butene isomers. The preferred alkylbenzenes are polypropyl, polybutyl and copolymer propylbutylbenzenes. Especially preferred are polypropylbenzenes wherein the alkyl moiety has a number average molecular weight of from 400 to about 1,000. The alkaline metal salt which is used to overbase the alkylsulfonic acids may be chosen from a group consisting of barium oxide, calcium oxide, calcium hydroxide magnesium oxide or other Group I and II metal bases. Preferably, the overbased sulfonic acids are produced from calcium oxide. The alkylbenzenes are commonly sulfonated with fuming sulfuric acid or oleum in standard industrial sulfonation procedures. The sulfonate is overbased when the sulfonate contains more base than is needed to neutralize the sulfonic acid. Degrees of overbasing can be measured in the form of total base number by ASTM D-2896. Total base number is equivalent to the milligrams of KOH equivalent to the amount of base in the composition which exceeds the amount needed to neutralize the sulfonic acids. TBNs of 1–400 are common.

Finally, Component (5) is an organo-sulfur compound preferably selected from the group consisting of an organo-sulfur compound. While any organo-sulfur compound can be used in the present invention, preferred are compounds selected from the group consisting of sulfurized olefins, sulfurized fatty acids and esters, sulfur-containing heterocyclic compounds, sulfurized hydroxy-aromatic compounds, disulfides, dithiocarbamates and thiadiazoles. Also included is a substituted 1,3,4-thiadiazole. For example, 2,5-dimercapto-1,3,4-thiadiazole, 2,5-bis(hydrocarbyldithio)-1,3,4-thiadiazole, 2-mercapto-5-hydrocarbyldithio-1,3,4-thiadiazole, 2,5-bis(hydrocarbylthio)-1,3,4-thiadiazole, and the like.

While additional additive agents may be incorporated in the lubricating compositions of the present invention, it is preferred that the lubricant composition of the present invention exclude zinc-containing wear agents if the lubricating compositions are used in diesel engines containing silver parts. This exclusion is intended to exclude amounts of zinc-containing wear inhibitors such as the zinc dihydrocarbyl dithiophosphate compounds sufficient to exert a measurable deleterious effect upon silver parts. At lesser amounts having no measurable effect, the lubricant is considered essentially free of zinc compounds for purposes of the present invention. If used in other engine or lubrication environments which do not contain silver parts, the additives of the present invention can provide useful lubricity, wear, and anticorrosion properties and may be used in conjunction with zinc compounds. For example, the lubricating compositions of the present invention can be used in automatic transmission fluids where the inclusion of zinc-containing wear inhibitors may be desirable.

Insofar as the present invention provides effective substitutes for chlorine-containing silver-wear agents, such as chlorinated paraffins, preferred embodiments of the lubricating compositions of the present invention are those excluding such agents.

The present invention is further illustrated by the following examples which are not, however, to be construed as limitations thereof.

EXAMPLES

Unless otherwise noted, the examples were mixed into a lubricant formulation. The formulation included the following components:

| Component | Weight Percent* |
|---|---|
| Mannich Dispersant | 3.3 |
| Calcium Mannich Phenate | 2.3 |
| Calcium Sulfonate | 2.0 |
| Calcium Sulfurized Phenate | 3.0 |
| 1,3,4-thiadiazole** | 0.1 |
| Silver-wear and copper-corrosion protection additive | 0.6 |
| Base Oils*** | Remainder |

*Weight percent of the total composition
**bis(2,5-nonyldithio)-1,3,4-thiadiazole
***A mixture of mid-continent base oils The silver wear testing was conducted as follows: A 0.5 inch polished steel ball was rotated at 600 rpm on three 6 mm silver disks which were immersed in the test oil in a heated holder (177° C.). A 23 kg load was applied and the test was run for 30 minutes. Thereafter, the disks were removed and the wear scar made by the steel ball was measured and reported in mm.

The oxidative thickening test was conducted at 160° C. Air was bubbled through a fritted glass tube through 100 g of test oil for 161 hours. Copper and iron coupons were suspended in the oil to serve as oxidation catalysts.

The copper rating test was conducted according to ASTM Method D-130. A reading of 3b or below was considered good.

Total base number (TBN) was the quantity of acid expressed in terms of the equivalent number of milligrams of potassium hydroxide that is required to neutralize all basic constituents present in one gram of a given sample. This method of evaluation is described in ASTM Method D-2896.

EXAMPLE 1

To 50 g (1.0 mole) of hydrazine monohydrate was added 51.1 g (1.0 mole) of 90% formic acid, and the mixture was stirred for one hour at 93° C. To this was added 306.5 g (1.087 mole) oleic acid. The mixture was stirred for 2 hours at 160° C. and diluted with 340 g of 100 neutral mid-continent lubricating oil (SX-5) (680 g product, 36 TBN). Moles per mole oleic acid: hydrazine 0.92, formic acid 0.92.

EXAMPLE 2

To 300 g (6.0 mole) of hydrazine monohydrate was added 306.6 g (6.0 mole) of 90% formic acid, and the mixture was stirred for 30 minutes at 93° C. To this was added 1839 g (6.52 mole) oleic acid. The mixture was diluted with 401 g SX-5 and stirred for 2 hours at 160° C. After adding 2041 g SX-5, the product (4483 g) was filtered (39 TBN, 4.41% N). Moles per mole oleic acid: hydrazine 0.92, formic acid 0.92.

EXAMPLE 3

A mixture of 70 g (0.25 mole) oleic acid and 13.8 g (0.23 mole) formic hydrazide (available from Aldrich Chemical) was heated to 16° C. for 2 hours and diluted with 73.6 g SX-5 (145.6 g product, 3.5% N).

Silver wear and copper corrosion results for the lubricant formulations of Examples 1–3 are reported in Table I below.

TABLE I

| | Example 1 | Example 2 | Example 3 |
|---|---|---|---|
| Silver Wear (mm) | 2.2 | 2.3 | 2.4 |
| Cu rating* | 3b | 3b | 3b |
| % Viscosity Increase** | | | |
| 48 hrs. | 8 | 7 | 3 |
| 72 hrs. | 17 | 17 | 10 |
| 96 hrs. | 39 | 30 | 23 |
| 161 hrs. | 364 | 195 | 211 |

*3b or below is considered good
**160° C. Oxidative Thickening Test

In Examples 1 and 2, the low temperature reaction of hydrazine and formic acid was followed by reaction with oleic acid. Silver wear (2.2–2.3 mm), copper corrosion (3b), and percent viscosity increase were good. Example 3 was prepared by reacting a commercial formyl hydrazine with oleic acid. The performance of Example 3 was comparable to Examples 1 and 2, and an infrared spectrum of Example 3 was nearly identical to that of Examples 1 and 2.

COMPARATIVE EXAMPLE A

To 282 g (1.0 mole) of Industrene 105 oleic acid (available from Humko Chemical Division of Witco Corp.) was added 46.0 g (0.92 mole) of hydrazine monohydrate (0.92 moles hydrazine per mole of oleic acid). The mixture was warmed slowly to 160° C. while stripping with nitrogen and stirred for one hour to give 299 g of hydrazine oleamide (or oleic hydrazide). The silver wear and copper corrosion results are reported in Table II below.

COMPARATIVE EXAMPLE B

To 100 g (2.0 moles) of hydrazine monohydrate was added 102.2 g (2.0 moles) of 90% formic acid between 23° C. and 71° C. Water was stripped off with nitrogen to 129° C. to yield 97.5 g of product.

To 150 g (90.51 mole) of the product from Comparative Example A was added 28.0 g (0.47 mole) of the hydrazine monohydrate/formic acid product from above. The mixture was stirred at 160° C. for one hour and 182° C. for 0.5 hour, and diluted with 173.7 g of SX-5 to give 340 g of product (44 TBN, 5.05% N). Silver wear and copper corrosion results are reported in Table II below.

TABLE II

| | Example A | Example B |
|---|---|---|
| Silver Wear (mm) | 1.0 | 2.1 |
| Cu rating | 4a | 4a |
| % Viscosity Increase* | | |
| 48 hrs. | 13 | 20 |
| 72 hrs. | 33 | 60 |
| 96 hrs. | 131 | 179 |
| 161 hrs. | TV** | TV |

*160° C. Oxidative Thickening Test
**Too viscous to measure

As can be seen from Table II, although the hydrazine oleamide (Comparative Example A) gave good silver wear, the viscosity increase was poor and the copper coupon was corroded. Also, the addition of formylhydrazine (Comparative Example B) gave a larger viscosity increase and a poorer copper rating.

When Examples 1–3 are compared to Comparative Examples A and B it can be seen that it is the reaction product of hydrazine, formic acid, and a $C_5$–$C_6$ monocarboxylic acid (in this case oleic acid) that produces a unique additive that provides unique silver-wear and copper-corrosion reducing properties. In other words, when all three components are not reacted to provide a single, unique additive, the beneficial silver wear and copper corrosion attributes are not produced.

The silver wear of commercial railroad oils is most commonly controlled by the addition of chlorinated or sulfurized/chlorinated additives. As is shown in the following Comparative Example C below, Chlorowax 40 gives poor oxidation and copper corrosion.

COMPARATIVE EXAMPLE C

A commercially available lubricant, Chlorowax 40 (a 40% by weight chlorinated hydrocarbon product available from Keil Chemical Division of Ferro Crop.) was tested to determine silver wear and copper corrosion. The results are reported in Table V below.

COMPARATIVE EXAMPLE D

To a mixture of 141 g (0.5 mole) of oleic acid and 25.6 g (0.5 mole) of formic acid with 30 g SX-5 was added 55.4 g (0.92 mole) ethylenediamine. The mixture was stirred for 2 hours at 149° C. Silver wear and copper corrosion results are reported in Table V below.

COMPARATIVE EXAMPLE E

A mixture of 282 g (1.0 mole) oleic acid, 55.3 g (0.46 mole) ethylenediamine, and 320 g SX-5 was stirred at 135° C. for one hour and filtered. A lubricant formulation was prepared with 3.5 wt. % calcium sulfurized phenate, 3.3 wt. % Mannich dispersant, 2 wt. % calcium sulfonate, 1.7 wt. % calcium Mannich phenate, and 0.2 wt. % 1,3,4-thiadiazole. Silver wear and copper corrosion results are reported in Table V below.

COMPARATIVE EXAMPLE F

A mixture of 94.6 g (0.5 mole) tetraethylenepentamine and 51.1 g (1.0 mole) of 90% formic acid was reacted for 2 hours at 182° C. Oleic acid was then added (146 g, 0.52 mole) and the mixture was reacted for 1 hour at 149° C. and 2 hours at 182° C. Silver wear and copper corrosion results are reported in Table III below.

TABLE V

| | Example C | Example D | Example E | Example F |
|---|---|---|---|---|
| Silver Wear (mm) | 2.1 | 1.8 | 1.9 | 1.6 |
| Cu rating | 4a | 4a | 4b | 4b |
| % Viscosity Increase* | | | | |
| 48 hrs. | 12 | 21 | 115 | 45 |
| 72 hrs. | 37 | 4817 | TV | 111 |
| 96 hrs. | 76 | 126 | TV | 1417 |
| 161 hrs. | TV** | TV | TV | 1519 |

*160° C. Oxidative Thickening Test
**Too viscous to measure

As can be seen from Table V, Chlorowax 40 (Comparative Example C) controls silver wear but gives poor oxidation and copper corrosion inhibition. Similarly, silver-wear and copper-corrosion protection additives made from ethylenediamine (Comparative Example D) and tetraethylenepentamine (Comparative Example E) gave products that controlled silver wear but resulted in poor oxidation and copper corrosion inhibition. These Comparative Examples show that not all amines produce an additive that provides both silver wear and copper corrosion protection.

This invention has been described in terms of specific embodiments set forth in detail. It should be understood, however, that these embodiments are presented by way of illustration only, and that the invention is not necessarily limited thereto. Modifications and variations within the spirit and scope of the claims that follow will be readily apparent from this disclosure, as those skilled in the art will appreciate.

That which is claimed is:

1. (Amended three times) An internal combustion engine lubricating composition comprising a major proportion of an oil of lubricating viscosity and *(1)* from about 0.01 weight percent to about 10 weight percent, based on the weight of the total lubricating composition, of a silver-wear and copper-corrosion protection additive comprising the reaction product of a $C_5$ to $C_{60}$ aliphatic monocarboxylic acid, formic acid, and at least one hydrazine *compound* of the formula:

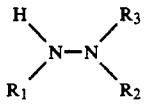

(I)

wherein $R_1$, $R_2$, and $R_3$ are independently selected from hydrogen, $C_1$ to $C_{20}$ hydrocarbyl, and hydroxy-substituted hydrocarbyl wherein the mole ratio of *the* hydrazine *compound* to monocarboxylic acid is from about 0.8:1 to about 1.5:1, and the mole ratio of *the* hydrazine *compound* to formic acid is from about 0.5:1 to about 1.5:1*; and (2) from about* 0.01 to about 1 weight percent, *based on the weight* of the total *lubricating* composition, of an organo-sulfur compound selected from the group consisting of sulfurized olefins, sulfurized fatty acids and esters, sulfur-containing heterocyclic compounds, sulfurized hydroxy-aromatic compounds, disulfides, dithiocarbamates and thiadiazoles.

2. The internal combustion engine lubricating composition of claim 1 wherein the lubricating oil is a mineral oil.

3. The internal combustion engine lubricating composition of claim 1 wherein the lubricating oil is a synthetic oil.

4. The internal combustion engine lubricating composition of claim 1 wherein the carboxylic acid is oleic acid.

5. The internal combustion engine lubricating composition of claim 1 which is essentially free of chlorine-containing silver-wear and copper-corrosion protection additive.

6. The internal combustion engine lubricating composition of claim 1 wherein the organo-sulfur compound is a 1,3,4-thiadiazole compound.

7. The internal combustion engine lubricating composition of claim 6 wherein the 1,3,4-thiadiazole compound is bis(2,5-nonyldithio)-1,3,4-thiadiazole.

8. The internal combustion engine lubricating composition of claim 1 further including a minor amount, effective for dispersancy, of an ashless dispersant, and a minor amount, effective for detergency, of at least one detergent selected from the group consisting of alkali and alkaline earth metal sulfonates, phenates and salicylates.

9. An internal combustion engine lubricating composition comprising a major proportion of an oil of lubricating viscosity and (1) from about 0.01 weight percent to about 10 weight percent, based on the weight of the total lubricating composition of a silver-wear and copper-corrosion protection additive comprising the reaction product of a hydrazine, formic acid, and a $C_5$ to $C_{60}$ carboxylic acid, (2) a minor amount, effective for dispersancy, of an ashless dispersant, (3) a minor amount, effective for detergency, of at least one detergent selected from the group consisting of alkali and alkaline earth metal sulfonates, phenates and salicylates; and (4) from about 0.01 to about 1 weight percent of the total composition of an organo-sulfur compound selected from the group consisting of sulfurized olefins, sulfurized fatty acids and esters, sulfur-containing heterocyclic compounds, sulfurized hydroxy-aromatic compounds, disulfides, dithiocarbamates and thiadiazoles.

10. The internal combustion engine lubricating composition of claim 9 wherein the carboxylic acid is oleic acid.

11. (Twice Amended) The internal combustion engine lubricating composition of Claim *9* [11] wherein the organo-sulfur compound is a 1,3,4-thiadiazole compound.

12. The internal combustion engine lubricating composition of claim 11 wherein the 1,3,4-thiadiazole compound is bis(2,5-nonyldithio)-1,3,4-thiadiazole.

13. (Amended three times) A method for protecting silver engine parts and inhibiting corrosion of an internal combustion engine which method comprises the step of contacting the internal portion of said engine with a lubricating composition comprising a major portion of an oil of lubricating viscosity and *(1)* and a minor amount of a silver-wear and copper-corrosion protection additive composition comprising the reaction product of a hydrazine *compound*, formic acid, and a $C_5$ to $C_{60}$ carboxylic acid, wherein the mole ratio of *the* hydrazine *compound* to monocarboxylic acid is from about 0.8:1 to about 1.5:1, and the mole ratio of *the* hydrazine *compound* to formic acid is from about 0.5:1 to about 1.5:1*; and (2) from about* 0.01 to about 1 weight percent of the total composition of an organo-sulfur compound selected from the group consisting of sulfurized olefins, sulfurized fatty acids and esters, sulfur-containing heterocyclic compounds, sulfurized hydroxy-aromatic compounds, disulfides, dithiocarbamates and thiadiazoles.

14. The method of claim 13 wherein the lubricating oil is a mineral oil.

15. The method of claim 13 wherein the lubricating oil is a synthetic oil.

16. The method of claim 13 wherein the carboxylic acid

17. The method of claim 13 further wherein said lubricating composition include a minor amount, effective for dispersancy, of an ashless dispersant, and a minor amount, effective for detergency, of at least one detergent selected from the group consisting of alkali and alkaline earth metal sulfonates, phenates and salicylates.

* * * * *

UNITED STATES PATENT AND TRADEMARK OFFICE

CERTIFICATE OF CORRECTION

PATENT NO. : 5,302,304
DATED : April 12, 1994
INVENTOR(S) : Joseph J. Valcho

It is certified that error appears in the above-indentified patent and that said Letters Patent is hereby corrected as shown below:

Claim 1, column 13, line 35, delete "(Amended three times)".

Claim 11, column 14, line 46, delete "(Twice Amended)".

Claim 11, column 14, line 47, delete "[11]".

Claim 13, column 14, line 53, delete (Amended three times)".

Signed and Sealed this

Eighteenth Day of October, 1994

*Attest:*

Bruce Lehman

BRUCE LEHMAN

*Attesting Officer*

*Commissioner of Patents and Trademarks*